US009687720B2

(12) United States Patent
Su

(10) Patent No.: US 9,687,720 B2
(45) Date of Patent: Jun. 27, 2017

(54) APPARATUS AND METHOD FOR DETECTING SPORTS BIOMECHANICAL INFORMATION

(71) Applicant: STRENGTH MASTER FITNESS TECH CO., LTD., Changhua County (TW)

(72) Inventor: Gary Su, Changhua County (TW)

(73) Assignee: Strength Master Fitness Tech Co., Ltd., Changhua County (TW)

( * ) Notice: Subject to any disclaimer, the term of this patent is extended or adjusted under 35 U.S.C. 154(b) by 448 days.

(21) Appl. No.: 14/294,248

(22) Filed: Jun. 3, 2014

(65) Prior Publication Data

US 2015/0343262 A1 Dec. 3, 2015

(51) Int. Cl.
*A63B 71/06* (2006.01)
*A63B 22/00* (2006.01)
(Continued)

(52) U.S. Cl.
CPC ..... *A63B 71/0619* (2013.01); *A63B 22/0012* (2013.01); *A63B 22/0664* (2013.01); *A63B 22/203* (2013.01); *A63B 2022/0676* (2013.01); *A63B 2024/009* (2013.01); *A63B 2024/0065* (2013.01); *A63B 2220/34* (2013.01); *A63B 2220/56* (2013.01); *A63B 2220/803* (2013.01);
(Continued)

(58) Field of Classification Search
CPC ..... A63B 71/0619; A63B 22/0664; A63B 22/0012; A63B 22/203; A63B 2220/833; A63B 2220/805; A63B 2220/34; A63B 2024/009; A63B 2022/0676; A63B 2220/56; A63B 2220/803; A63B 2024/0065
See application file for complete search history.

(56) References Cited

U.S. PATENT DOCUMENTS 8,246,555 B2 * 8/2012 Chiu ..... A61B 5/1122 482/1
2011/0118086 A1 * 5/2011 Radow ..... A63B 21/00196 482/5

(Continued)

OTHER PUBLICATIONS

"AMT203 Absolute Rotary Encoders." Optical Encoder PTM Provided by Digi-Key and Grayhill. CUI Inc, n. d. Web. Sep. 17, 2016.http://dkc1.digikey.com/US/en/TOD/Grayhill/OpticalEncoder/Optical_Encoders.html>.*

*Primary Examiner* — Sundhara Ganesan
(74) *Attorney, Agent, or Firm* — Rosenberg, Klein & Lee

(57) ABSTRACT

An apparatus for detecting sports biomechanical information includes a rotating device, pedaled and rotated by a stepping portion, and a transmission mechanism being dragged, such that the stepping portion forms a moving track corresponding to the motion of the rotating device. Plural equidistant first sensing portions are disposed around the axis of the rotating device and sensed by a first sensor, and a second sensing portion is disposed on the rotating device and sensed by a second sensor, and the stepping portion includes a pressure sensor for sensing a stepping pressure exerted on the stepping portion. The aforementioned sensors generate first, second and third signals respectively, and the computing module computes the current position of the stepping portion and works together with reverse sport biomechanics of a human body to compute limbs loading information of human body movements.

13 Claims, 8 Drawing Sheets

(51) Int. Cl.
*A63B 22/06* (2006.01)
*A63B 22/20* (2006.01)
*A63B 24/00* (2006.01)

(52) U.S. Cl.
CPC ... *A63B 2220/805* (2013.01); *A63B 2220/833* (2013.01)

(56) References Cited

U.S. PATENT DOCUMENTS

2012/0277063 A1* 11/2012 Zhang ..... A61B 5/4595 482/8
2013/0245511 A1* 9/2013 Pidcoe ..... A61H 1/001 601/33
2014/0221160 A1* 8/2014 Hardy ..... A63B 24/0062 482/8

* cited by examiner

APPARATUS AND METHOD FOR DETECTING SPORTS BIOMECHANICAL INFORMATION

FIELD OF THE INVENTION

The present invention relates to an apparatus and method for detecting sports biomechanical information, in particular to the apparatus and method for detecting a stepping position in an exercise.

BACKGROUND OF THE INVENTION

To maintain good health and keep fit, working out at leisure time becomes a trend, and many people achieve the training effect by using and operating fitness equipments. As science and technology advance, a fitness equipment with 3D image capturing system is introduced, and such fitness equipment captures 3D images of a user during exercise, and analyzes and compares the image to obtain the calorie burned out by the user while operating the fitness equipment, and the information is provided as a reference for the user to plan the amount of exercise and check the exercise achievement.

However, the user has to attach a sensing pad for capturing the 3D images onto the user's body or wear a sensing sportswear for the use of the aforementioned equipment, and thus causing inconvenience to the exercise. On the other hand, such equipment used for analyzing the user's exercise conditions is expensive, and thus not suitable for a general public use.

SUMMARY OF THE INVENTION

In view of the aforementioned drawbacks of the prior art, it is a primary objective of the present invention to provide an apparatus and method for detecting sports biomechanical information, wherein various types of sensors are used for sensing a change of the current position of the sports equipment that produces a motion by stepping, and the Inverse Kinematicsof human body is used to compute the user's sport biomechanical information.

To achieve the aforementioned objective, the present invention provides an apparatus for detecting sports biomechanical information, comprising: a base frame, having a rotating shaft and a rotating device installed thereon, wherein the rotating device is coupled to a transmission mechanism, and the transmission mechanism includes a stepping portion for producing a motion by stepping on the stepping portion, and the transmission mechanism drives the rotating device to rotate the rotating shaft, while the stepping portion is dragged by the transmission mechanism to move and form a track of the corresponding rotating device; and the rotating shaft includes a turntable mounted thereon and rotated synchronously with the rotating shaft; a first sensing device, having a plurality of equidistant first sensing portions disposed on the turntable and around the rotating shaft, each rotating and moving with the turntable, and the first sensing device further having a first sensor installed on the base frame, for sensing each first sensing portion and respectively generating a first signal when the first sensor senses each first sensing portion; a second sensing device, having a second sensing portion disposed on the turntable, and the second sensing portion rotating and moving with the turntable, and the second sensing device further having a second sensor installed on the base frame, for sensing the second sensing portion and generating a second signal when the second sensor senses the second sensing portion; and a pressure sensor, installed at the stepping portion, for sensing a stepping pressure exerted on the stepping portion to generate a third signal.

Wherein, the transmission mechanism includes a crank and a stepping rod, and the crank is installed and coupled to the rotating shaft, and the other end of the crank is pivotally installed at the stepping rod, and the stepping portion is disposed on the stepping rod.

Wherein, the first sensing portion includes a plurality of teeth disposed at the periphery of the turntable and arranged equidistantly with a spacing apart from one another; and the first sensor includes a transmitter and a receiver, and the transmitter and the receiver are installed on both sides of the turntable respectively.

In another preferred embodiment of the first sensing device, the first sensing portion is a block magnet, and the first sensor is a Hall sensor.

The rotating device further includes a third sensing device installed thereon, and the third sensing device has a third sensor installed on the base frame for sensing the first sensing portion and respectively generating a fourth signal in each sensing, and the third sensor is installed at a position such that the difference between the phase angle of the fourth signal and the phase angle of the first signal is equal to 90 degrees.

In addition, the present invention further provides a method for detecting sports biomechanical information, for computing limbs loading information of a human body movement during the process of a user stepping on a stepping machine, wherein the stepping machine comprises a rotating device coupled to a transmission mechanism, and the transmission mechanism has a stepping portion for producing a motion when the user steps on the stepping portion, and the transmission mechanism drives the rotating device to rotate, while the stepping portion is being dragged by the transmission mechanism to move and form a track corresponding to the rotating device; and the rotating device has a coaxial and synchronously rotating turntable; and the method comprising the steps of: using a first sensing device to sense a plurality of first sensing portions installed on the turntable one by one to generate a first signal, wherein the first sensing portions are disposed around the axis of the turntable, arranged equidistantly from one another, and rotated together with the turntable; using a second sensing device to sense a second sensing portion installed on the turntable to generate a second signal, wherein the second sensing portion rotates with the turntable; using a pressure sensor to sense a stepping pressure exerted onto the stepping portion to generate a third signal, wherein the pressure sensor is installed at the stepping portion; using a computing module to receive the first signal and the second signal and compute the quantity of first signals received after receiving the second signal in order to convert and compute the current position of the stepping portion; and computing the limbs loading information of the human body movement during the stepping process with the computing module by the current position of the stepping portion and the third signal.

In the aforementioned method, the computing module includes inertia data of each limb of a human body, and the human limb includes a thigh and a leg, and the computed limbs loading information includes a force and a torque.

The present invention will become clearer in light of the following detailed description of an illustrative embodiment of this invention described in connection with the drawings. It is intended that the embodiments and drawings disclosed herein are to be considered illustrative rather than restrictive.

DESCRIPTION OF THE PREFERRED EMBODIMENTS

Figure 1:
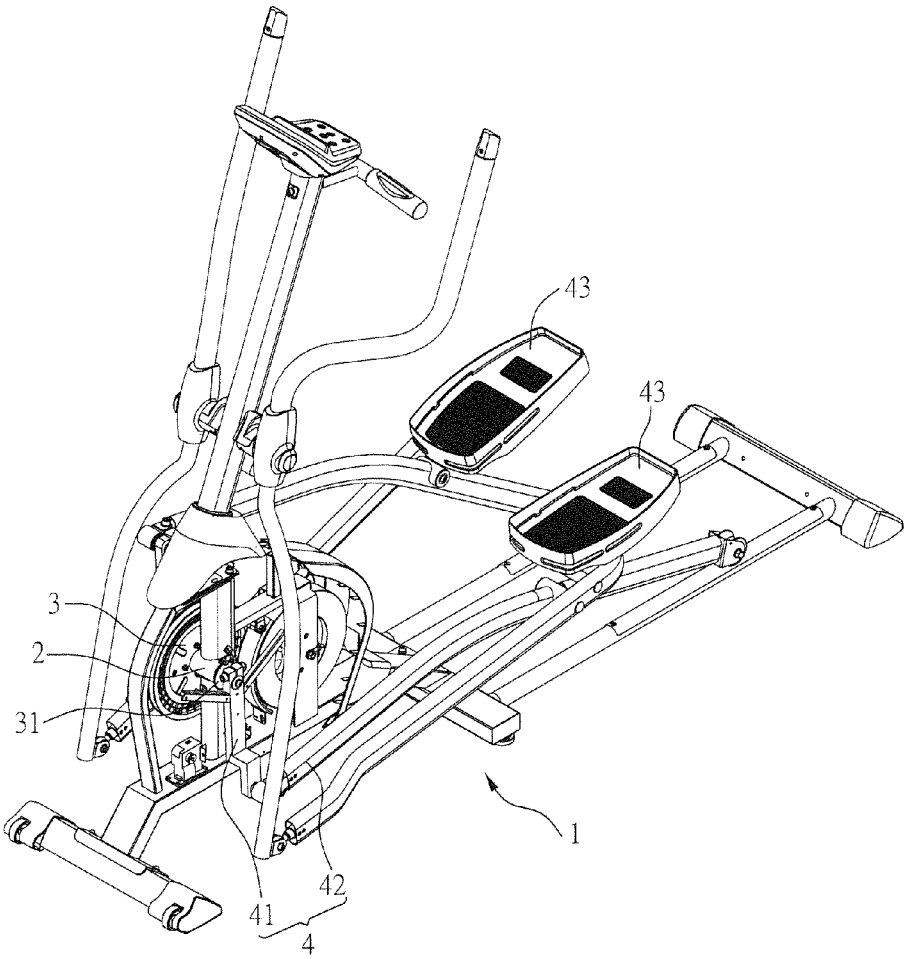
FIG. 1 is a perspective view of an apparatus for detecting sport biomechanical information in accordance with a first preferred embodiment of the present invention.
Figure 2:
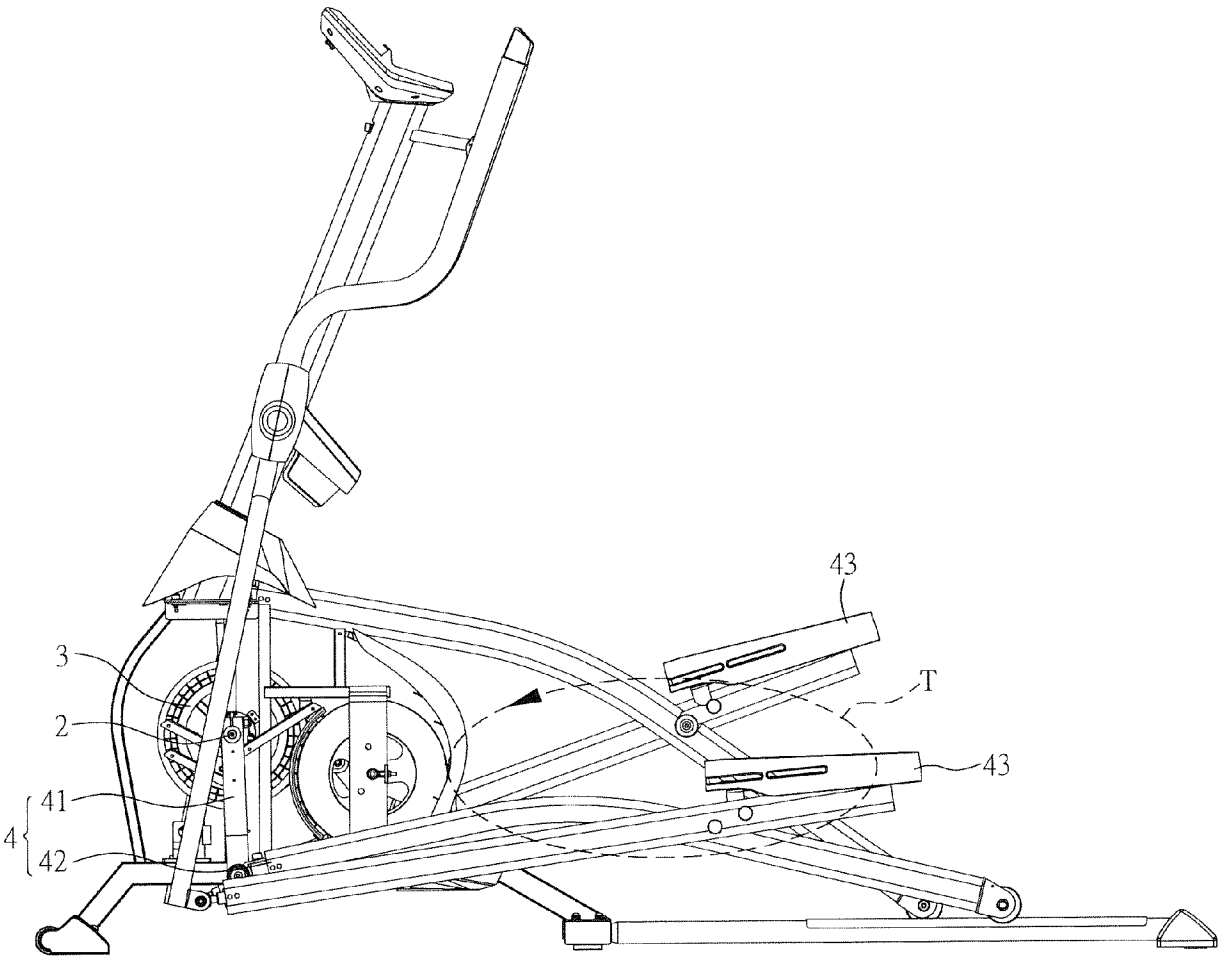
FIG. 2 is a schematic view of an apparatus for detecting sport biomechanical information in accordance with the first preferred embodiment of the present invention, wherein the dotted line indicates the track of a pedal.
Figure 3A:
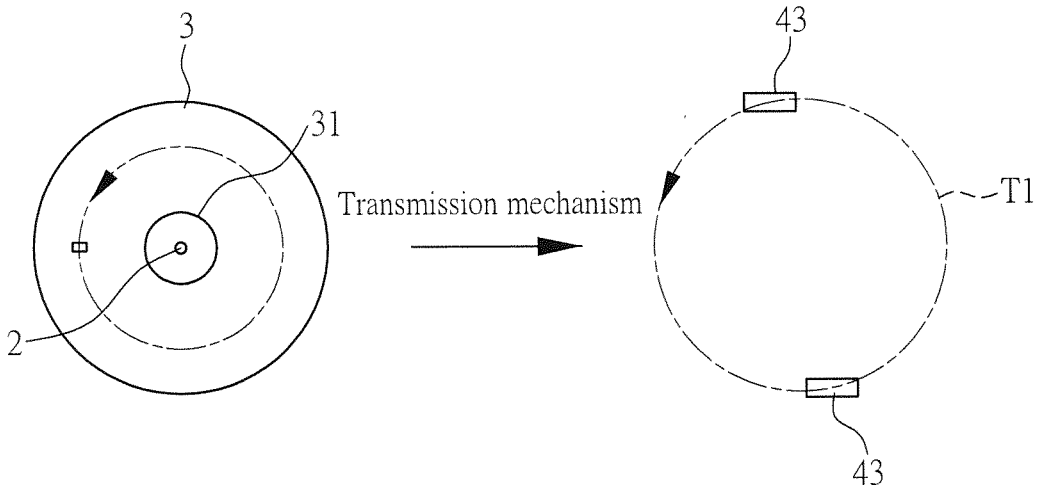
FIGS. 3*a* to 3*c* are schematic views of different tracks formed by the pedal of an apparatus for detecting sport biomechanical information of the present invention.
Figure 3B:
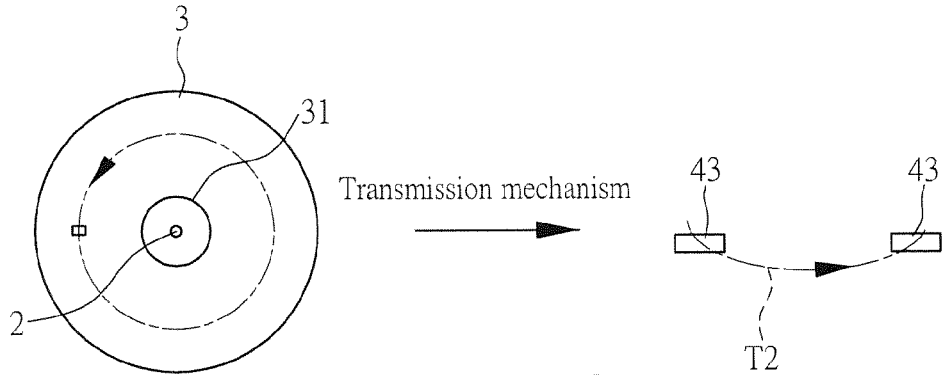
Figure 3C:
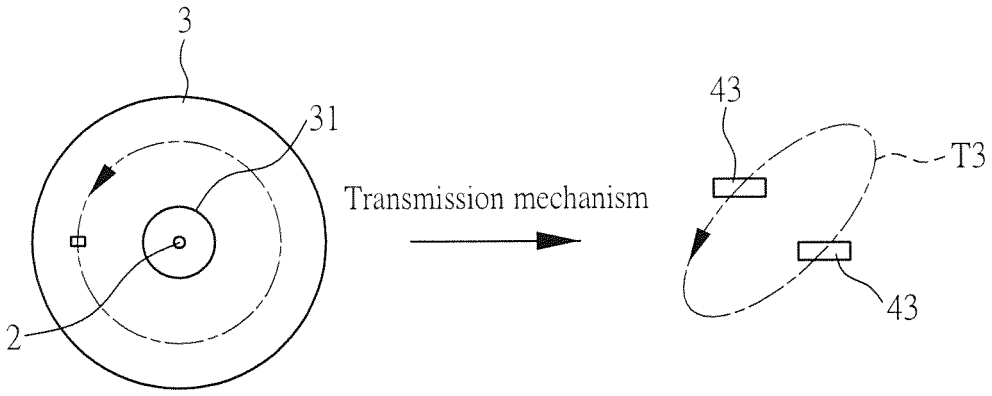

With reference to FIGS. 1 and 2 for an apparatus for detecting sports biomechanical information in accordance with the first preferred embodiment of the present invention, and the apparatus is in form of a elliptical trainer, comprising a base frame 1, having a rotating shaft 2 and a rotating device installed at the front of the base frame 1, wherein the rotating device is coupled to a transmission mechanism 4, and the transmission mechanism 4 includes a stepping portion for producing a motion by stepping on the stepping portion, and the transmission mechanism 4 drives the rotating device to rotate by using the rotating shaft 2 as an axis, while the stepping portion is being dragged by the transmission mechanism 4 to move and form a track corresponding to the motion of the rotating device. In this preferred embodiment, the rotating device is a wheel 3, and the rotating shaft 2 is installed at the axial center of the wheel 3, and the rotating shaft 2 is coupled to a crank 41, and a stepping rod 42 is pivotally installed at the other end of the crank 41, and the stepping rod 42 has a pedal 43 provided for a user to step thereon. In addition, the rotating shaft 2 further includes a turntable 31 coaxially and synchronously rotated with the wheel 3. Therefore, the crank 41 and the stepping rod 42 constitute the transmission mechanism 4, such that when the user steps on the pedal 43, the transmission mechanism 4 drives the rotating shaft 2 and the wheel 3, and the turntable 31 produces a circular motion. In the meantime, the crank 41 and the stepping rod 42 are dragged, so that the displacement of the pedal 43 forms a track T as shown in FIG. 2. Wherein, the pattern of the track T depends on the assembly and configuration of the transmission mechanism 4. In this preferred embodiment, the track is an elliptical track with a long axis extended in the horizontal direction, but the track of the pedal 43 may have different changes (T1, T2, T3) as shown in FIGS. 3*a* to 3*c* in different configurations of the transmission mechanism respectively. In the configuration of different types of transmission mechanisms, the pedal 43 has different tracks with respect to the circular motion track of the turntable 31. However, the cycles of strokes of the two are the same. In other word, if a positioning point is defined at the turntable 31, and the position of the positioning point situated on the circular track of the turntable 31 is defined as an initial position, and the position of the pedal 43 is also situated on the track to form a corresponding initial position corresponsive to the initial position. If the positioning point moves with the turntable 31 along the circular track to complete one stroke and returns to the initial position, then the pedal 43 will move along the track to complete one stroke and return to the corresponding initial position. Therefore, the pedal 43 always has a fixed corresponding position with respect to each position of the positioning point in its stroke.

Figure 4:
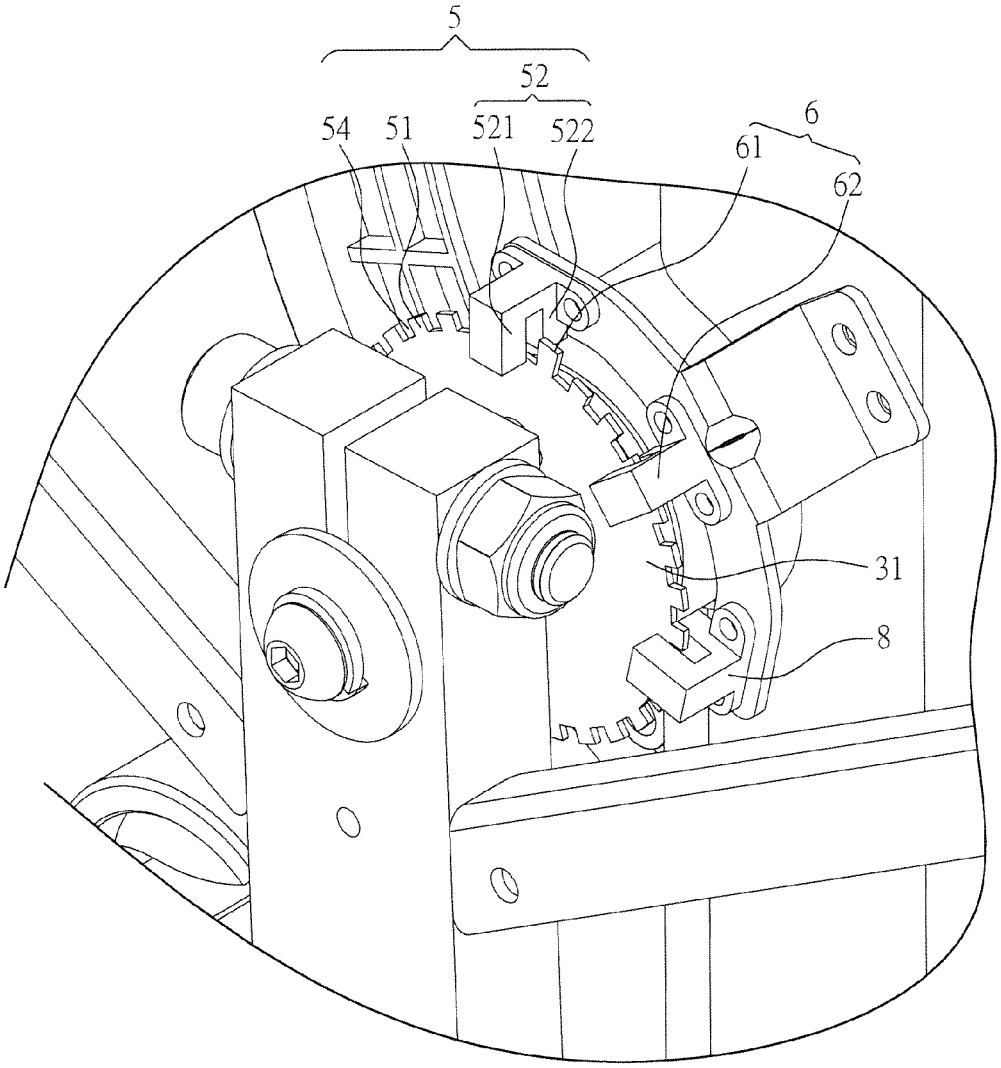
FIG. 4 is a partial blowup view of an apparatus for detecting sport biomechanical information in accordance with the first preferred embodiment of the present invention.

In the aforementioned structure, the present invention comprises a sensing device for detecting the position of the pedal 43 immediately as shown in FIG. 4, and the sensing device comprises a first sensing device 5 and a second sensing device 6. Wherein, the first sensing device 5 includes a plurality of equidistant first sensing portions disposed on the turntable 31 and around the rotating shaft (not shown in the figure), and each first sensing portion will rotate together with the turntable 31 and move along a circular track. The first sensing device 5 includes a first sensor 52 installed onto the base frame for sensing each first sensing portion, wherein a first signal is generated when the first sensor 52 senses any of the first sensing portions. In this preferred embodiment, the first sensing device 5 adopts a grating sensing method. More specifically, the first sensing portions are a plurality of teeth 51 disposed at the periphery of the turntable 31 and arranged equidistantly with a spacing 54 apart from one another, and the first sensor 52 includes a transmitter 521 and a receiver 522, wherein the transmitter 521 and the receiver 522 are installed at two fixed positions on both sides of the turntable 31 respectively. The transmitter 521 emits light towards the turntable 31, and each tooth 51 is situated on a track where the light is passed. Since each tooth 51 and each spacing 54 are separated from each other, therefore when the turntable 31 rotates, the light meets each tooth 51 and each spacing 54 alternately, wherein if the light meets each spacing 54, the light will be able to pass through and will be received by the receiver 522 to generate a first signal; and if the light meets each tooth 51, the light will be blocked and unable to pass through. Therefore, the light is received and blocked alternately during the rotation of the turntable 31 to generate the first signals continuously (when the light is received).

Further, the second sensing device 6 includes a second sensing portion disposed on the turntable 31 and rotated together with the turntable 31 to move along a circular track. In this preferred embodiment, the second sensing portion is one of the teeth 61 on the turntable 31, wherein the tooth 61 has a height greater than other teeth 51. In addition, the second sensing device 6 has a second sensor 62 installed at a fixed position on the base frame, and the tooth 61 will pass through the second sensor 62 once when the turntable 31 is rotated for one round, so that the second sensor 62 can sense the tooth 61 and generate a second signal. In this preferred embodiment, the tooth 61 can be detected by the second sensor 62 through different conventional methods to generate a second signal. It is noteworthy to mention that there is a height difference between the tooth 61 and other teeth 51, so that the second sensor 62 will not sense the tooth 51 or generate any unnecessary sensing signal.

After the first signal and the second signal sensed by the first sensing device 5 and the second sensing device 6 are computed, the position of the pedal 43 can be obtained. More specifically, each position on the track of the turntable 31 is corresponsive to one fixed position of the track of the pedal 43, so that as long as an angular displacement of the rotation of a certain positioning point on the turntable 31 is detected, the current position of the pedal 43 can be converted and computed. In actual motions, as the turntable 31 is rotated, the tooth 61 is sensed by the second sensor 62 once for every round of the rotation of the turntable 31, so as to generate a second signal, and then a computing/processing unit will show that the turntable 31 has completed a rotating stroke once whenever a second signal is received. In the meantime, as the turntable 31 is rotated, a first signal will be generated for every fixed angle under the effect of the first sensor 52. In summation, the quantity of the first signals received after receiving the second signal can be used for computing the position to where the turntable 31 is rotate, in order to convert and compute the current position of the pedal 43. After the current position of the pedal 43 is obtained, the current positions of the user's leg and foot as well as the corresponding stepping posture can be estimated.

In this preferred embodiment, a pressure sensor (not shown in the figure) is installed in the pedal 43 for sensing a stepping pressure exerted onto the pedal 43 to generate a third signal. With the aforementioned technology of detecting the current position of the pedal 43, the first signal, second signal and third signal can be compiled to compute the force applied by the user to each position of the pedal 43.

Figure 5:
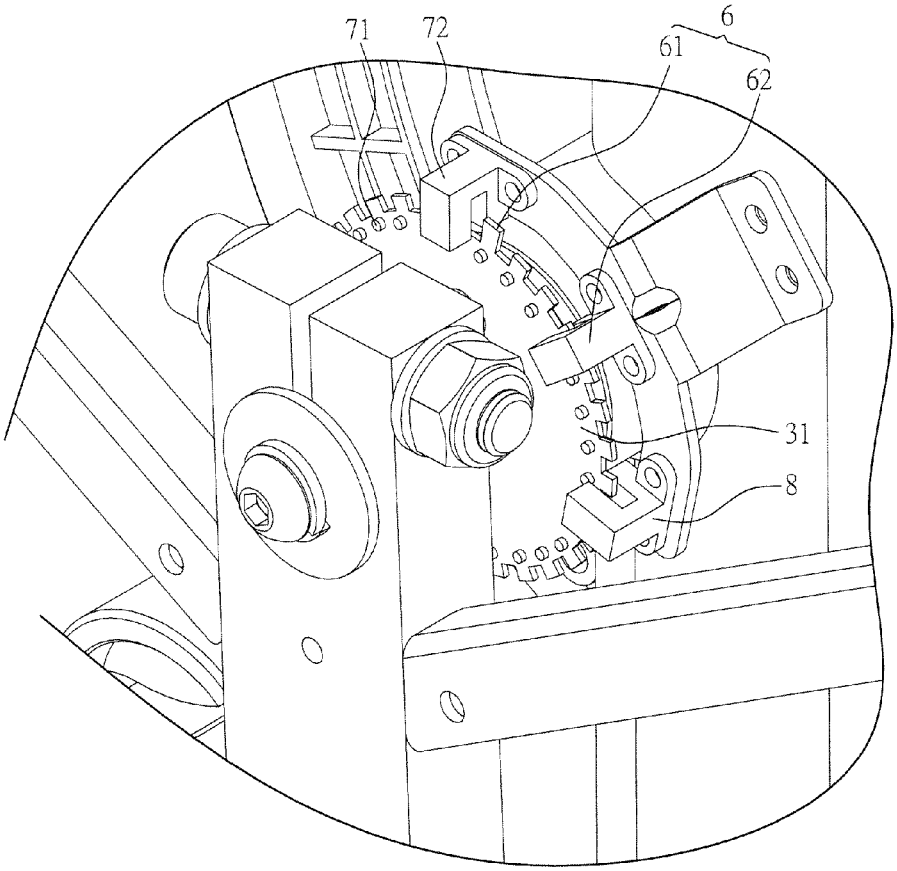
FIG. 5 is a partial blowup view of an apparatus for detecting sport biomechanical information in accordance with a second preferred embodiment of the present invention.

With reference to FIG. 5 for the second preferred embodiment of the present invention, this preferred embodiment is another implementation mode of the first sensing device of the previous preferred embodiment, wherein the first sensing portion is a block magnet 71, and each block magnet 71 is installed and disposed equidistantly around the rotating shaft (not shown in the figure), and the block magnet 71 will rotate together with the turntable 31 to move along a circular track. The first sensor is a Hall sensor 72 installed at a fixed position of the base frame. As the turntable 31 rotates, the block magnets 71 will pass through the Hall sensor 72 sequentially to form a change of voltage which is used to generate the first signal. In this preferred embodiment, the remaining components are the same as those of the first preferred embodiment, and thus will not be described again. This preferred embodiment can also achieve the effect of detecting the current position of the pedal.

In the foregoing two preferred embodiments of the present invention, the turntable 31 further comprises a third sensing device, and the third sensing device includes a third sensor 8 installed on the base frame for sensing the first sensing portion and generating a fourth signal for each sensing, wherein the third sensor 8 is installed at a position where the difference between the phase angle of the fourth signal and the phase angle of the first signal is equal to 90 degrees. When the user pedals the pedals in a forward or reverse direction, the turntable 31 and the first sensing portion disposed on the turntable 31 will rotate in the forward or reverse direction accordingly. Since the first sensing portion passes through the first sensor 52 and the third sensor 8 to generate the first signal and the fourth signal, the sequence of the received first signal and the received fourth signal can be used for determining the rotating direction of the turntable 31. The information of the current position of the pedal together with the information of the rotating direction can be used to obtain more useful computing information.

Figure 6:
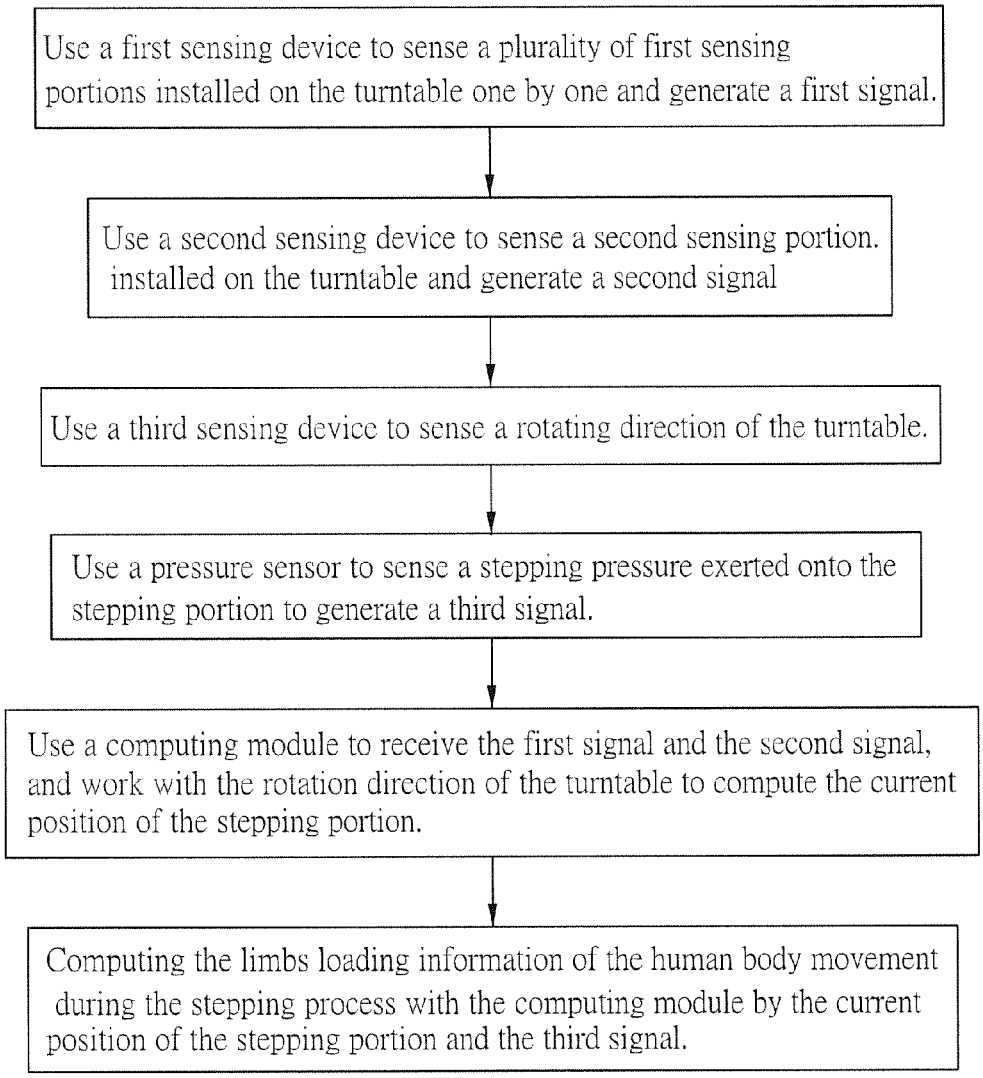
FIG. 6 is a flow chart of a method for detecting sport biomechanical information in accordance with the present invention.

The present invention further provides a method for detecting sports biomechanical information, for computing limbs loading information of a human body movement during the process of a user stepping on a stepping machine, wherein the stepping machine comprises a rotating device coupled to a transmission mechanism, and the transmission mechanism has a stepping portion for producing a movement when the user steps on the stepping portion, and the transmission mechanism drives the rotating device to rotate, while the stepping portion is being dragged by the transmission mechanism to move and form a track corresponding to the rotating device; and the rotating device has a coaxial and synchronously rotating turntable. The method as shown in FIG. 6 comprises the following steps:

Use a first sensing device to sense a plurality of first sensing portions installed on the turntable one by one to generate a first signal respectively, wherein the first sensing portions are disposed around the axis of the turntable, arranged equidistantly from one another, and rotated together with the turntable.

Use a second sensing device to sense a second sensing portion installed on the turntable to generate a second signal, wherein the second sensing portion rotates with the turntable.

Use a pressure sensor to sense a stepping pressure exerted onto the stepping portion to generate a third signal, wherein the pressure sensor is installed at the stepping portion.

Use a computing module to receive the first signal and the second signal and compute the quantity of first signals received after receiving the second signal in order to convert and compute the current position of the stepping portion.

Finally, computing the limbs loading information of the human body movement during the stepping process with the computing module by the current position of the stepping portion and the third signal.

In addition, this method further comprises the step of using a third sensing device to sense a rotation direction of the rotating device.

In the aforementioned method, when a user steps on the stepping portion to drive the rotating device to rotate, the stepping portion will form a track, and the rotating stroke of the rotating device will be corresponsive to the track of the stepping portion, so that an angular displacement of the rotation of the turntable can be detected and used to calculate the current position of the stepping portion. The first sensing portions are disposed around the axis of the turntable, arranged equidistantly from one another, and rotated together with the turntable, so that the first sensing portions passing through the first sensing device will be detected one by one to generate multiple first signals continuously. Accordingly, the appearance of each first signal represents the angular displacement which the turntable rotates. On the other hand, the second sensing portion is also rotated together with the turntable and will be detected by the second sensing device to generate the second signal when passing through the second sensing device. A single second signal is generated in one whole stroke of the turntable so as to be used as a reference for calculation. The current position of the stepping portion is calculated with the quantity of first signals received after the second signal is received, wherein the quantity of first signals is used to calculate the sum of the angular displacement of the turntable.

This method further adds a third sensing device installed at a position having a phase angle with a difference of 90 degrees from the phase angle of the signal wave of the aforementioned first sensing device, and the signal wave is analyzed to determine the rotating direction of the turntable.

After the current position of the stepping portion and the stepping pressure exerted by the user onto the stepping portion are obtained, the computing module use this information as the boundary conditions together with the inertia data of each limb such as the length, centroid, and weight of a thigh or a leg, and human body inverse kinematics is used as a basis for computing the limbs loading information of a human body motion. Wherein, the limbs of the human body motion includes a thigh and a leg and the computation principle and formula adopted by the computing module of the present invention for computing the information such as the force and torque imposed on joints of the aforementioned limbs are disclosed in R.O.C. Pat. No. 201118627 and U.S. Pat. No. 8,246,555, and thus will not be repeated here.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. An apparatus for detecting sports biomechanical information, comprising:

a base frame, having a rotating shaft and a rotating device installed thereon, wherein the rotating device is coupled to a transmission mechanism, and the transmission mechanism includes a stepping portion for producing a motion by stepping on the stepping portion, and the transmission mechanism drives the rotating device to rotate the rotating shaft, while the stepping portion is dragged by the transmission mechanism to move and form a track of the corresponding rotating device; and the rotating shaft includes a turntable mounted thereon and rotated synchronously with the rotating shaft, the base frame defining a fixing seat spaced from and extending angularly about a portion of the turntable;

a first sensing device, having a plurality of equidistantly spaced first sensing portions disposed on the turntable and around the rotating shaft, each rotating and moving with the turntable, and the first sensing device further having a first sensor installed on the fixing seat, for sensing each first sensing portion and generating a first signal when the first sensor senses each first sensing portion;

a second sensing device, having a second sensing portion extending radially outward from at least one first sensing portion disposed on the turntable, and the second sensing portion rotating and moving with the turntable, and the second sensing device further having a second sensor installed on the fixing seat displaced in angular position from the first sensor, for sensing the second sensing portion and generating a second signal when the second sensor senses the second sensing portion; and a pressure sensor, installed at the stepping portion, for sensing a stepping pressure exerted on the stepping portion to generate a third signal.

2. The apparatus for detecting sports biomechanical information according to claim 1, wherein the first sensing portion includes a plurality of teeth disposed at the periphery of the turntable and arranged equidistantly with a spacing apart from one another; and the first sensor includes a transmitter and a receiver, and the transmitter and the receiver are installed on both sides of the turntable respectively.

3. The apparatus for detecting sports biomechanical information according to claim 1, wherein the first sensing portion is a block magnet, and the first sensor is a Hall sensor.

4. The apparatus for detecting sports biomechanical information according to claim 1, wherein the rotating device further includes a third sensing device installed thereon, and the third sensing device has a third sensor installed on the base frame for sensing the first sensing portion and generating fourth signal in each sensing, and the third sensor is installed at a position such that the difference between the phase angle of the fourth signal and the phase angle of the first signal is equal to a predetermined value.

5. The apparatus for detecting sports biomechanical information according to claim 4, wherein the predetermined value is equal to 90 degrees.

6. The apparatus for detecting sports biomechanical information according to claim 1, wherein the transmission mechanism includes a crank and a stepping rod, and the crank is installed and coupled to the rotating shaft, and the other end of the crank is pivotally installed at the stepping rod, and the stepping portion is disposed on the stepping rod.

7. A method for detecting sports biomechanical information, for computing limbs loading information of a human body movement during the process of a user stepping on a stepping machine, wherein the stepping machine includes a rotating device coupled to a transmission mechanism, and the transmission mechanism has a stepping portion for producing a motion when the user steps on the stepping portion, and the transmission mechanism drives the rotating device to rotate, while the stepping portion is being dragged by the transmission mechanism to move and form a track corresponding to the rotating device; and the rotating device has a coaxial and synchronously rotating turntable, the stepping machine including a base frame defining a fixing seat spaced from and extending angularly about a portion of the turntable; and the method comprising:

using a first sensing device having a first sensor installed on the fixing seat to sense a plurality of first sensing portions installed on the turntable one by one to generate a first signal, wherein the first sensing portions are disposed around the axis of the turntable, arranged equidistantly from one another, and rotated together with the turntable;

using a second sensing device having a second sensor installed on the fixing seat displaced in angular position from the first sensor to sense a second sensing portion extending radially outward from at least one first sensing portion installed on the turntable to generate a second signal, wherein the second sensing portion rotates with the turntable;

using a pressure sensor to sense a stepping pressure exerted onto the stepping portion to generate a third signal, wherein the pressure sensor is installed at the stepping portion;

using a computing module to receive the first signal and the second signal and compute the quantity of first signals received after receiving the second signal in order to convert and compute the current position of the stepping portion; and computing the limbs loading information of the human body movement during the stepping process with the computing module by the current position of the stepping portion and the third signal.

8. The method for detecting sports biomechanical information according to claim 7, wherein the limbs includes a thigh and a leg.

9. The method for detecting sports biomechanical information according to claim 7, wherein the computing module includes inertia data of each limb of a human body.

10. The method for detecting sports biomechanical information according to claim 7, wherein the computed limbs loading information includes a force or a torque.

11. The apparatus for detecting sports biomechanical information according to claim 1, wherein the plurality of equidistant first sensing portions includes a plurality of equidistant first teeth with a height A, the second sensing portion includes a tooth with a height greater than A.

12. An apparatus for detecting sports biomechanical information, comprising:

a base frame, having a rotating shaft and a rotating device installed thereon, wherein the rotating device is coupled to a transmission mechanism, and the transmission mechanism includes a stepping portion for producing a motion by stepping on the stepping portion, and the transmission mechanism drives the rotating device to rotate the rotating shaft, while the stepping portion is dragged by the transmission mechanism to move and form a track of the corresponding rotating device; and the rotating shaft includes a turntable mounted thereon and rotated synchronously with the rotating shaft;

a first sensing device, having a plurality of equidistant first sensing portions disposed on the turntable and around the rotating shaft, each rotating and moving with the turntable, and the first sensing device further having a first sensor installed on the base frame, for sensing each first sensing portion and generating a first signal when the first sensor senses each first sensing portion;

a second sensing device, having a second sensing portion disposed on the turntable, and the second sensing portion rotating and moving with the turntable, and the second sensing device further having a second sensor installed on the base frame, for sensing the second sensing portion and generating a second signal when the second sensor senses the second sensing portion; and a pressure sensor, installed at the stepping portion, for sensing a stepping pressure exerted on the stepping portion to generate a third signal;

wherein the rotating device further includes a third sensing device installed thereon, and the third sensing device has a third sensor installed on the base frame for sensing the first sensing portion and generating fourth signal in each sensing, and the third sensor is installed at a position such that the difference between the phase angle of the fourth signal and the phase angle of the first signal is equal to a predetermined value.

13. The apparatus for detecting sports biomechanical information according to claim 12, wherein the predetermined value is equal to 90 degrees.

* * * * *